US007654944B1

(12) United States Patent
Liu

(10) Patent No.: US 7,654,944 B1
(45) Date of Patent: Feb. 2, 2010

(54) FOLDABLE EXERCISE BENCH SYSTEM

(76) Inventor: Ping Liu, No. 8 Oianyingfang Street, Tiayuan, Shanxi (CN)

( * ) Notice: Subject to any disclaimer, the term of this patent is extended or adjusted under 35 U.S.C. 154(b) by 6 days.

(21) Appl. No.: 12/231,106

(22) Filed: Aug. 29, 2008

(51) Int. Cl.
*A63B 26/00* (2006.01)

(52) U.S. Cl. ..... 482/142; 482/140

(58) Field of Classification Search ..... 482/142, 482/92–100, 51
See application file for complete search history.

(56) References Cited

U.S. PATENT DOCUMENTS 5,232,426 A * 8/1993 Van Straaten ..... 482/123
6,605,023 B1 * 8/2003 Mobley ..... 482/142
6,645,130 B2 * 11/2003 Webber ..... 482/142
7,294,097 B2 * 11/2007 Parker ..... 482/142
7,335,145 B2 * 2/2008 Webber ..... 482/142

* cited by examiner

*Primary Examiner*—Lori Baker

(57) ABSTRACT

A base has a primary leg with a rear cross bar positionable on the ground. The primary leg has a raised forward end. The base has a secondary leg with a front cross bar positionable on the ground. The secondary leg is pivotably coupled to the primary leg. A seat rest is secured to the upper surface of the primary leg. A back rest is secured to the upper surface of the primary leg. A rearward adjustment assembly includes a pair of parallel adjustment bars with an upper pivot tube. The upper pivot tube pivotally couples the upper ends of the adjustment bars to the back rest. A slider is slidable along the primary leg. The adjustment bars are coupled to the slider beneath the primary tube. The adjustment bars couple the adjustment bars to the slider. In this manner pivoting of the back rest is allowed.

1 Claim, 10 Drawing Sheets

FOLDABLE EXERCISE BENCH SYSTEM

BACKGROUND OF THE INVENTION

1. Field of the Invention

The present invention relates to a foldable exercise bench system and more particularly pertains to being capable of being repositioned for supporting a user in any of a plurality of angular orientations while performing exercises.

2. Description of the Prior Art

The use of exercise benches of known designs and configurations is known in the prior art. More specifically, exercise benches of known designs and configurations previously devised and utilized for the purpose of supporting a user while exercising through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 7,294,097 issued Nov. 13, 2007 to Parker relates to an Articulated Bench and U.S. Pat. No. 7,335,145 issued Feb. 26, 2008 to Webber relates to a Folding Exercise Bench.

While these devices fulfill their respective, particular objectives and requirements, the aforementioned patents do not describe a foldable exercise bench system that allows for being repositioned for supporting a user in any of a plurality of angular orientations while performing exercises.

In this respect, the foldable exercise bench system according to the present invention substantially departs from the conventional concepts and designs of the prior art, and in doing so provides an apparatus primarily developed for the purpose of being repositioned for supporting a user in any of a plurality of angular orientations while performing exercises.

Therefore, it can be appreciated that there exists a continuing need for a new and improved foldable exercise bench system which can be used for being repositioned for supporting a user in any of a plurality of angular orientations while performing exercises. In this regard, the present invention substantially fulfills this need.

SUMMARY OF THE INVENTION

In view of the foregoing disadvantages inherent in the known types of exercise benches of known designs and configurations now present in the prior art, the present invention provides an improved foldable exercise bench system. As such, the general purpose of the present invention, which will be described subsequently in greater detail, is to provide a new and improved foldable exercise bench system and method which has all the advantages of the prior art and none of the disadvantages.

To attain this, the present invention essentially comprises a foldable exercise bench system. First provided is a base. The base has a primary leg. The base has a secondary leg. The primary leg is between 3 and 5 times the length of the secondary leg. The primary leg has a rearward end. The rearward end has a rear cross bar. The rear cross bar is positionable on the ground. The primary leg has a raised forward end. The secondary leg has a forward end. The forward end has a front cross bar. The front cross bar is positionable on the ground. The secondary leg has a rearward end. The rearward end is pivotably coupled to the forward end of the primary leg. The secondary leg has an intermediate cross bar. The intermediate cross bar is provided at an intermediate location. The intermediate cross bar functions as a foot rest. Each of the cross bars is provided parallel with the others with a circular cross section. Both of the legs have a rectangular cross section. The legs have an upper surface. The legs have a parallel lower surface. The legs have parallel side surfaces. The side surfaces are provided between the upper and lower surfaces.

A seat rest is provided. The seat rest has a lower surface. The lower surface is secured to the upper surface of the primary leg adjacent to the raised forward end. The seat rest has a cushioned upper surface. The upper surface is adapted to receive and support a seat of a user. The seat rest has a length of between about 15 and 25 percent of the length of the primary leg. A minor extent of the seat rest extends forwardly of the primary leg. In this manner an overhang is constituted. The seat rest has a forward handle. The forward handle extends forwardly from the forward end of the primary leg beneath the overhang.

Provided next is a back rest. The back rest has a free rearward end. The back rest has a forward end. The forward end is pivotally secured to the upper surface of the primary leg rearwardly of the seat rest. The back rest has a lower surface. The back rest has spaced parallel supports. The supports span the primary leg. The back rest has a cushioned upper surface. The upper surface is adapted to receive and support a back of a user. The back rest has a lateral handle. The lateral handle extends laterally from one of the parallel supports. The majority of the lateral handle is located beneath the back rest.

Further provided is a forward adjustment assembly. The forward adjustment assembly includes a pivot plate. The pivot plate extends downwardly from the lower surface of the primary leg adjacent to the forward end. The forward adjustment assembly includes a pivot pin. The pivot pin extends through the upper end of the secondary leg and the pivot plate. In this manner the pivoting of the secondary leg between a retracted orientation and an extended orientation is allowed. In the retracted orientation, the secondary leg is positioned adjacent to the primary leg. In this extended orientation, the secondary leg is positioned at an angle of between 80 and 100 degrees from the primary leg. The pivot plate has locking holes. The pivot plate has a locking pin. The locking pin is positioned through the secondary leg and a preselected locking hole for securement of the secondary leg in a preselected orientation.

Provided last is a rearward adjustment assembly. The rearward adjustment assembly includes a pair of parallel adjustment bars. The adjustment bars have upper ends. The upper ends have an upper pivot tube. The upper pivot tube pivotally couples the upper ends of the adjustment bars to the parallel supports. The rearward adjustment assembly includes a slider. The slider has a rectangular cross section. The rectangular cross section is slidable along the primary leg. The adjustment bars have lower ends. The lower ends have a lower pivot tube. The lower pivot tube is secured to the slider beneath the primary tube. The lower pivot tube couples the lower ends of the adjustment bars to the lower pivot tubes. In this manner the pivoting of the back rest between a retracted orientation and an extended orientation is allowed. In the retracted orientation, the back rest is positioned adjacent to the primary leg. In the extended orientation, the back rest is positioned at any of a plurality of angles of between 10 and 90 degrees from the primary leg. The slider has adjusting holes. The slider has an adjusting pin. The adjusting pin is positioned through the slider and a preselected locking hole for securement of the back rest in a preselected orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved foldable exercise bench system which has all of the advantages of the prior art exercise benches of known designs and configurations and none of the disadvantages.

It is another object of the present invention to provide a new and improved foldable exercise bench system which may be easily and efficiently manufactured and marketed.

It is further object of the present invention to provide a new and improved foldable exercise bench system which is of durable and reliable constructions.

An even further object of the present invention is to provide a new and improved foldable exercise bench system which is susceptible of a low cost of manufacture with regard to both materials and labor, and which accordingly is then susceptible of low prices of sale to the consuming public, thereby making such foldable exercise bench system economically available to the buying public.

Even still another object of the present invention is to provide a foldable exercise bench system for being repositioned for supporting a user in any of a plurality of angular orientations while performing exercises.

Lastly, it is an object of the present invention to provide a new and improved foldable exercise bench system. A base has a primary leg with a rear cross bar positionable on the ground. The primary leg has a raised forward end. The base has a secondary leg with a front cross bar positionable on the ground. The secondary leg is pivotably coupled to the primary leg. A seat rest is secured to the upper surface of the primary leg. A back rest is secured to the upper surface of the primary leg. A rearward adjustment assembly includes a pair of parallel adjustment bars with an upper pivot tube. The upper pivot tube pivotally couples the upper ends of the adjustment bars to the back rest. A slider is slidable along the primary leg. The adjustment bars are coupled to the slider beneath the primary tube. The adjustment bars couple the adjustment bars to the slider. In this manner pivoting of the back rest is allowed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
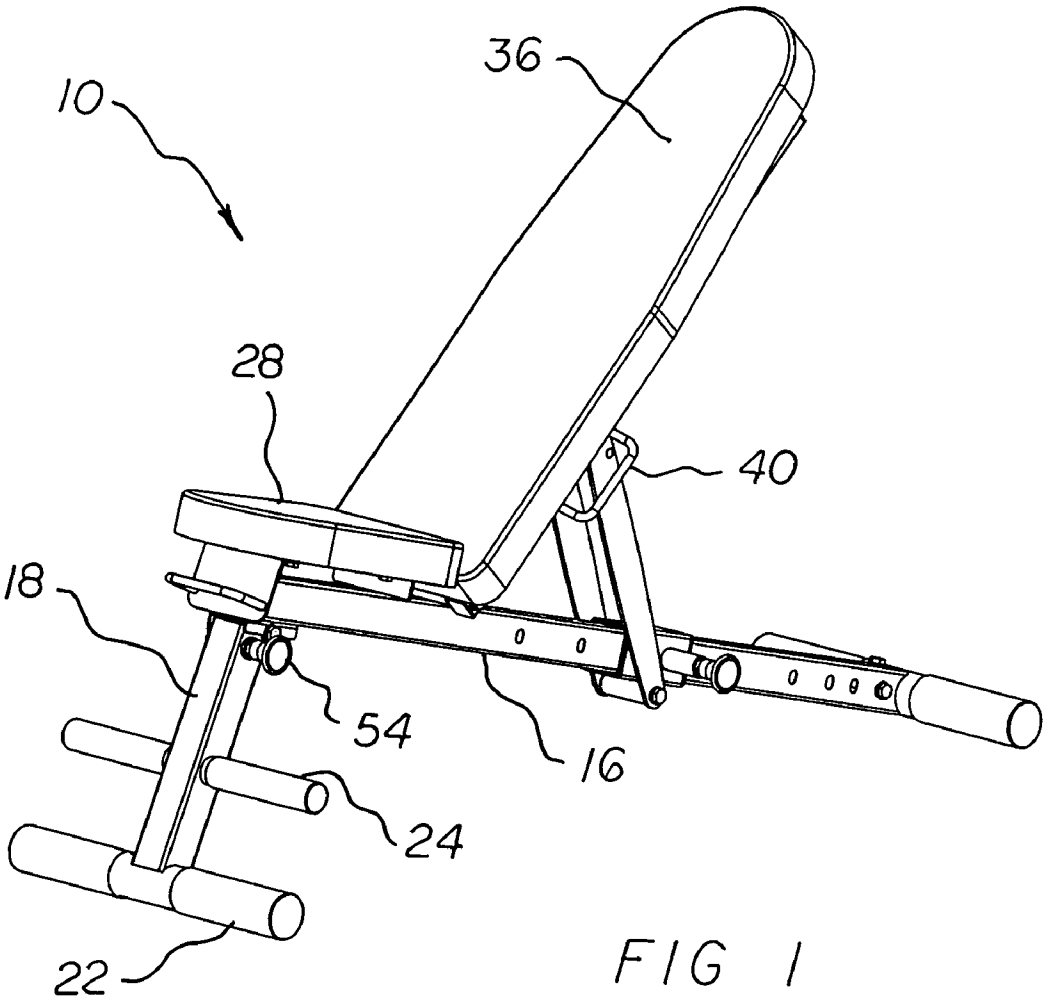
FIG. 1 is a perspective illustration of a foldable exercise bench system constructed in accordance with the principles of the present invention.
Figure 2:
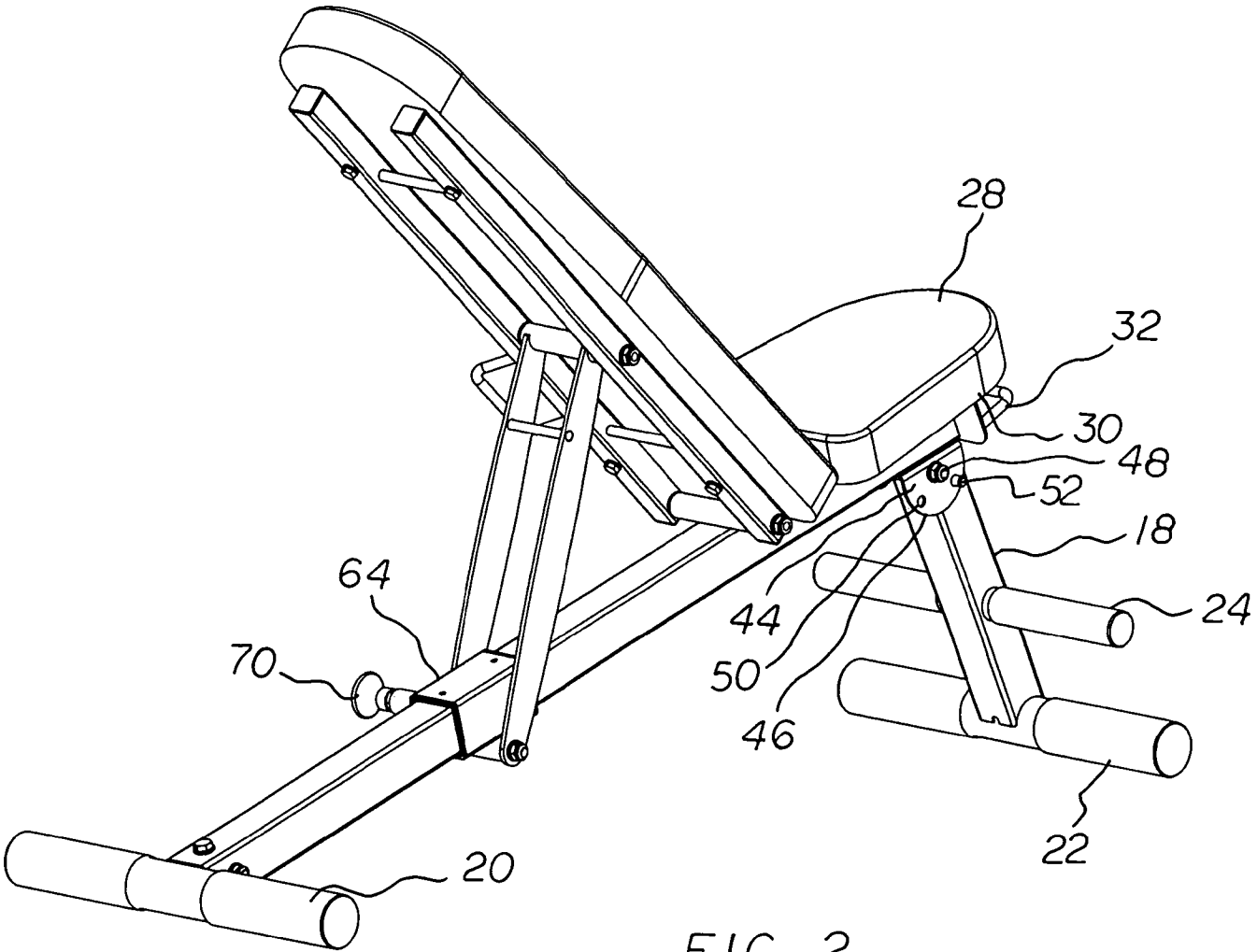
FIG. 2 is a perspective illustration of the foldable exercise bench system similar to FIG. 1 but viewed from the rear.
Figure 3:
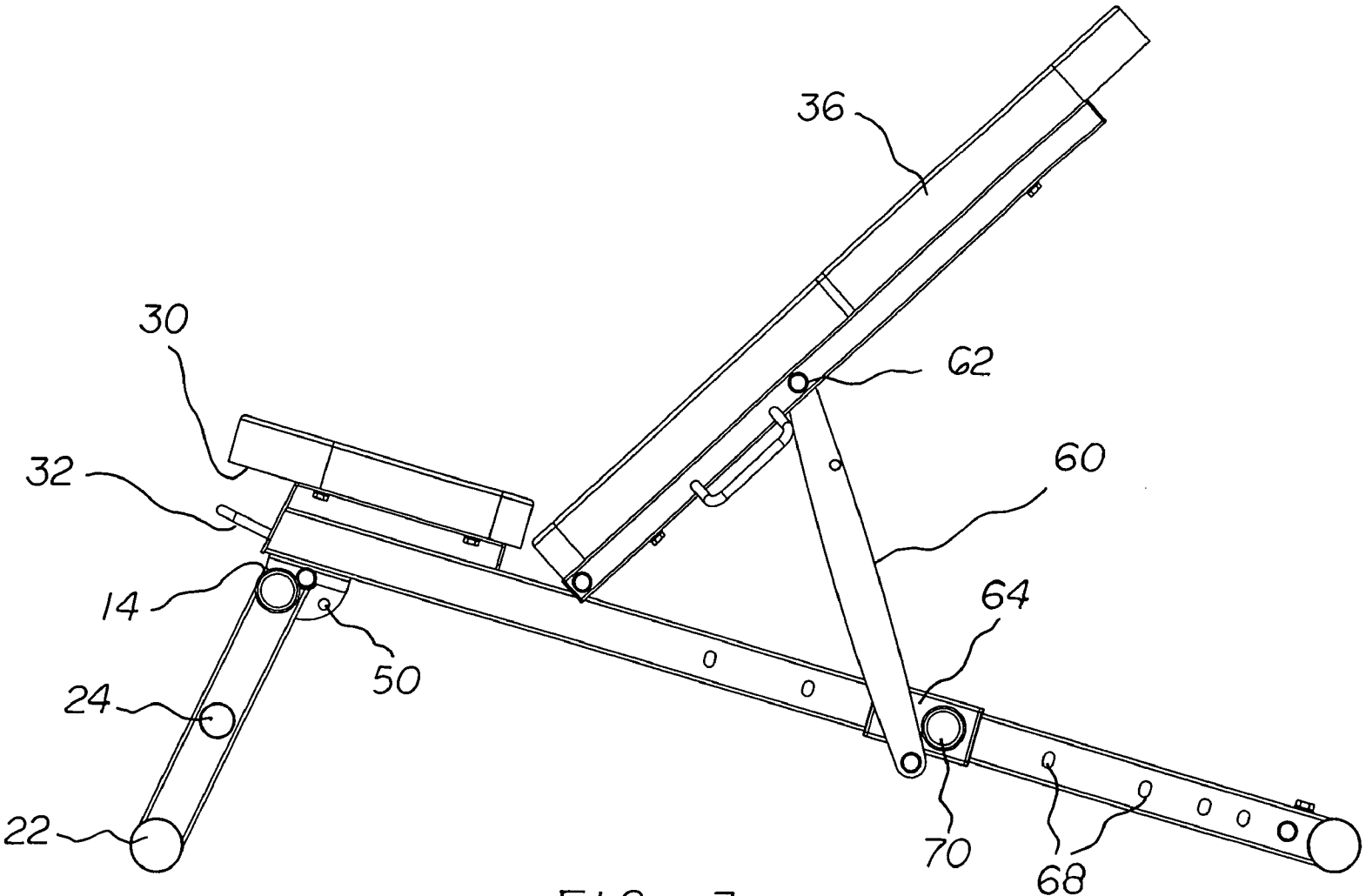
FIG. 3 is a side elevational view of the system shown in FIGS. 1 and 2.
Figure 4:
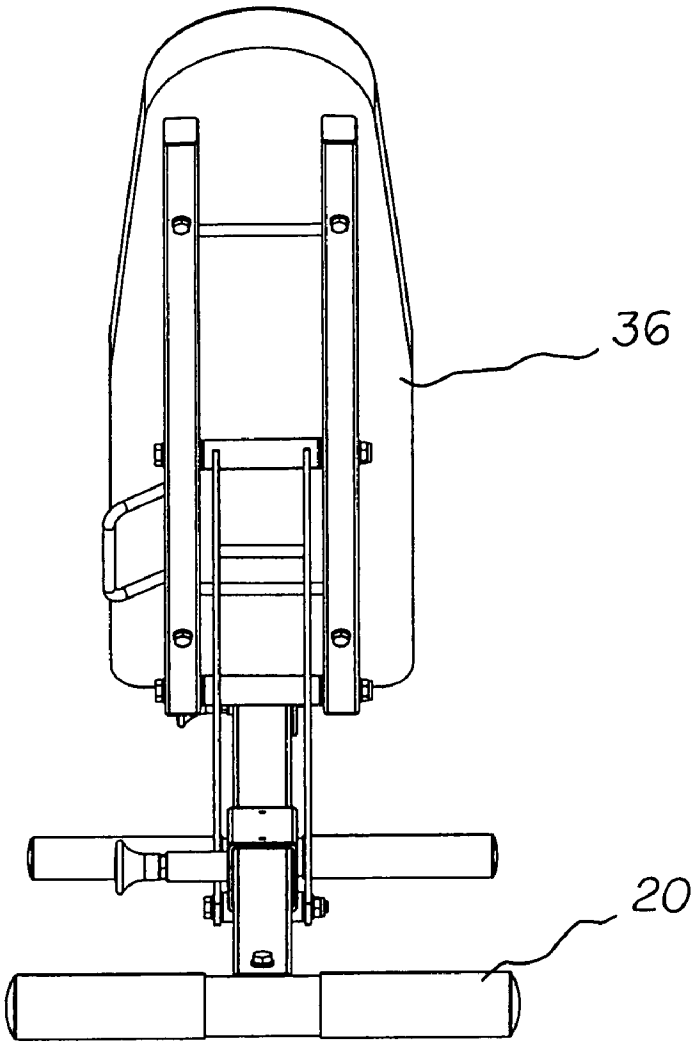
FIG. 4 is a rear elevational view of the system shown in the prior Figures.
Figure 5:
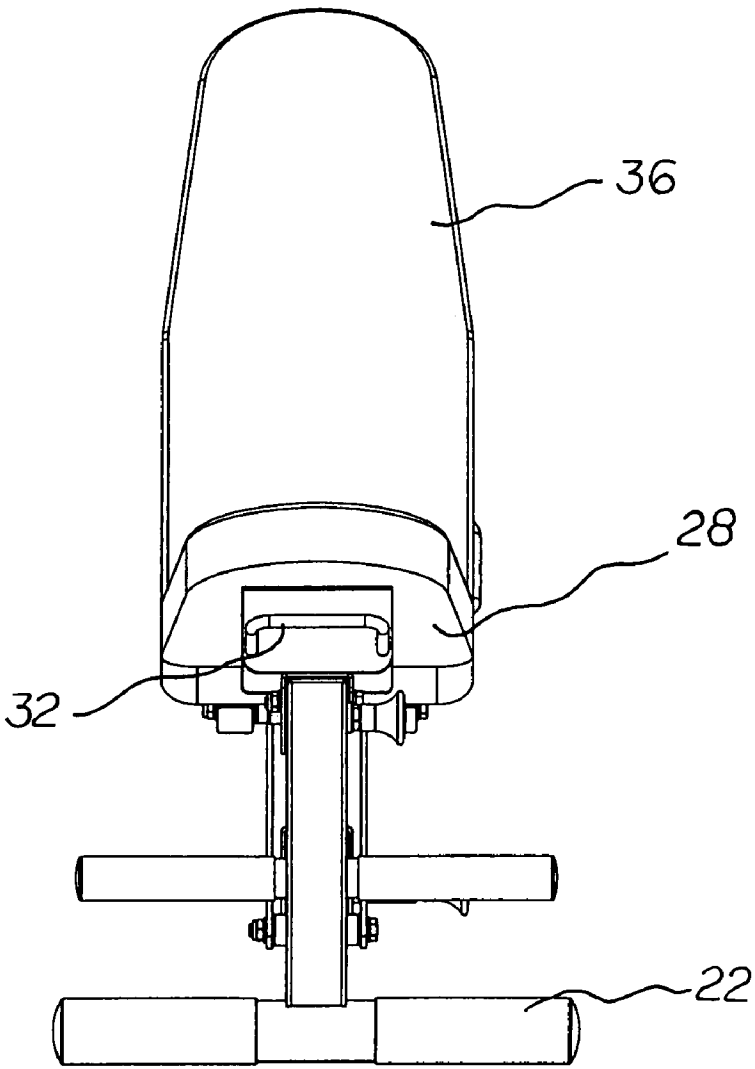
FIG. 5 is a front elevational view of the system shown in the prior Figures.
Figure 6:
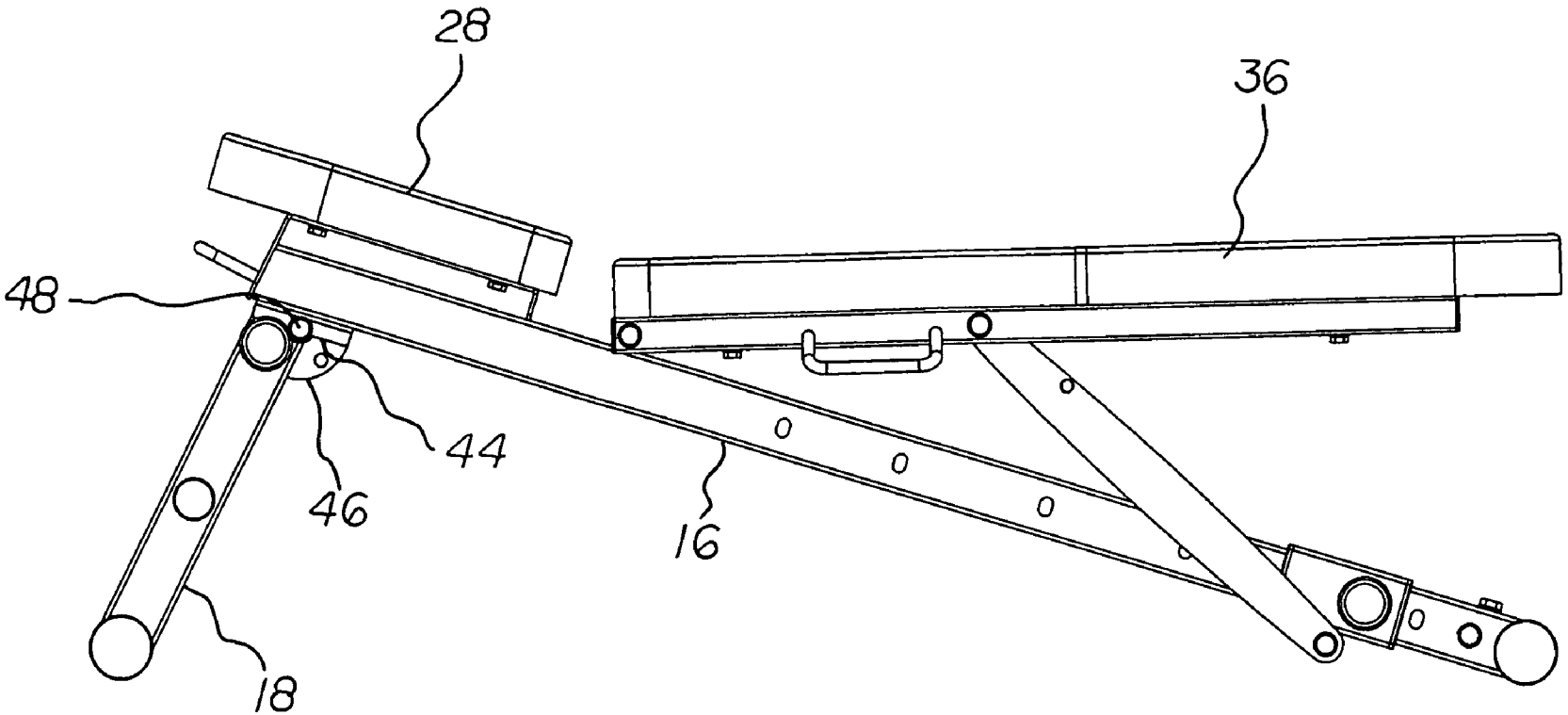
FIG. 6 is a side elevational view of the system similar to FIG. 3 but in a partially collapsed orientation.
Figure 7:
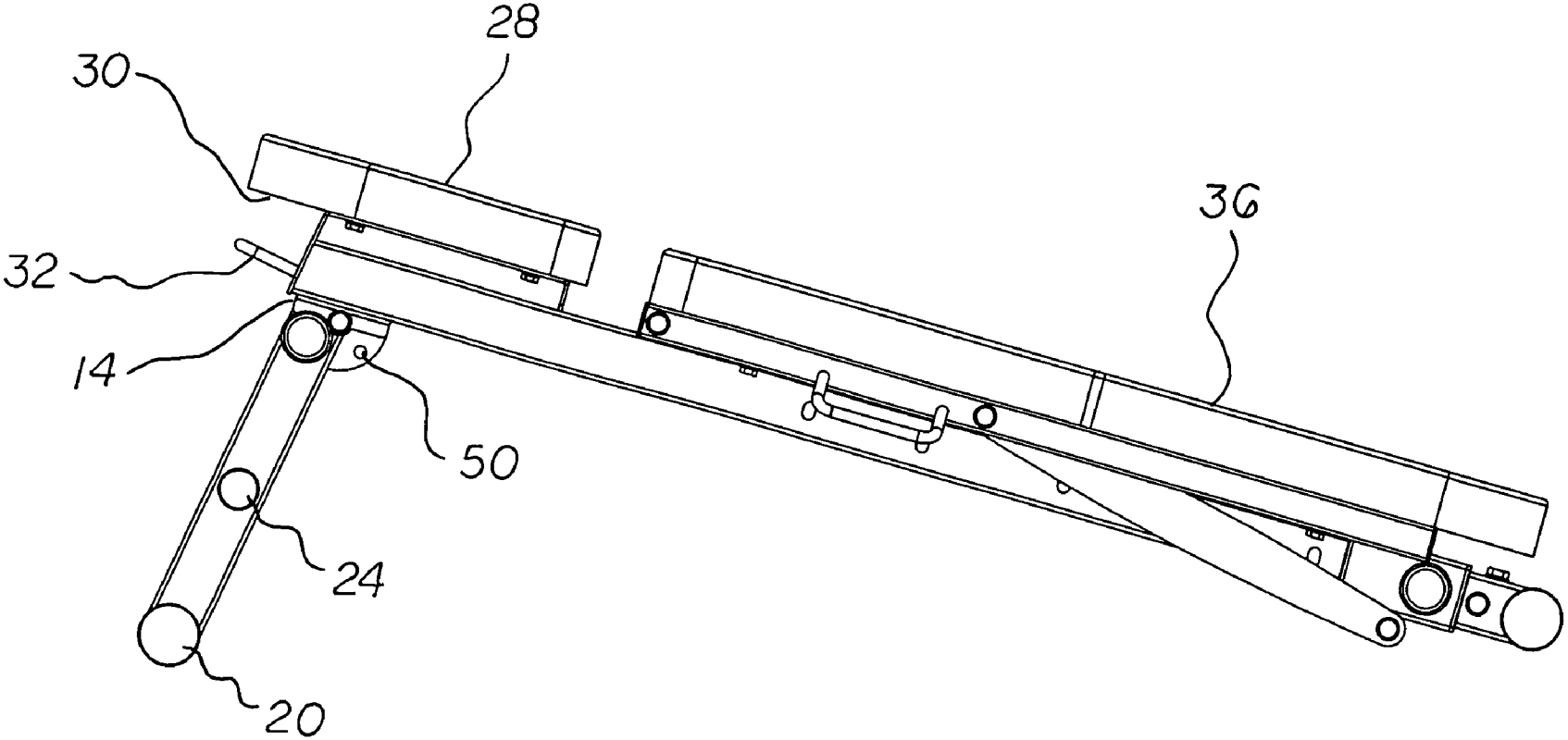
FIG. 7 is a side elevational view of the system similar to FIG. 6 but in an orientation of greater collapse.
Figure 8:
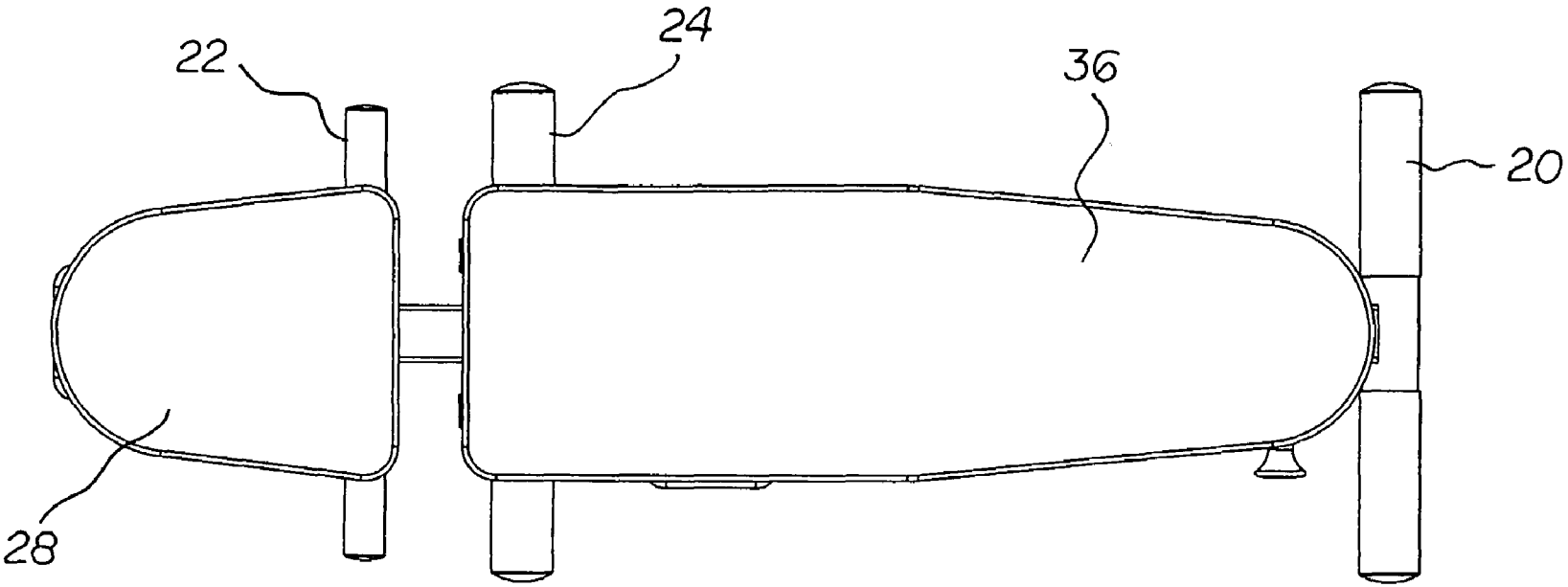
FIG. 8 is a plan view of the system shown in the prior Figures.
Figure 9:
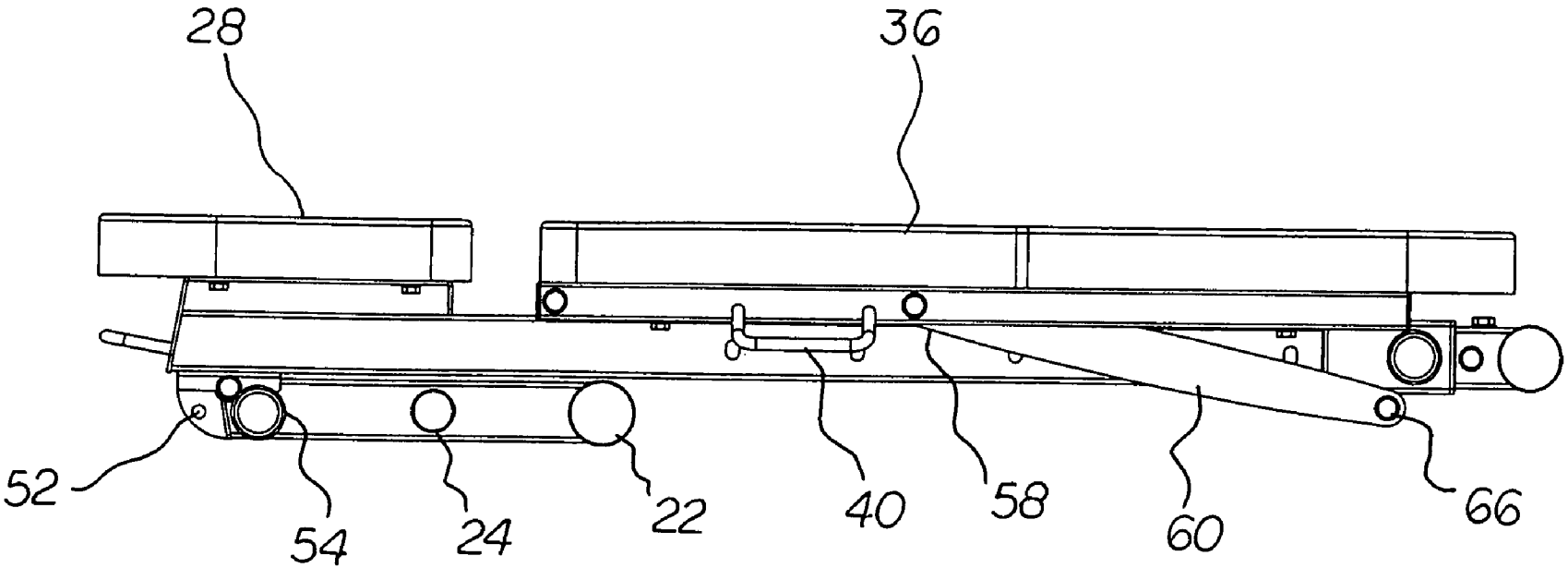
FIG. 9 is a side elevational view of the system similar to FIG. 7 but in an orientation of complete collapse.
Figure 10:
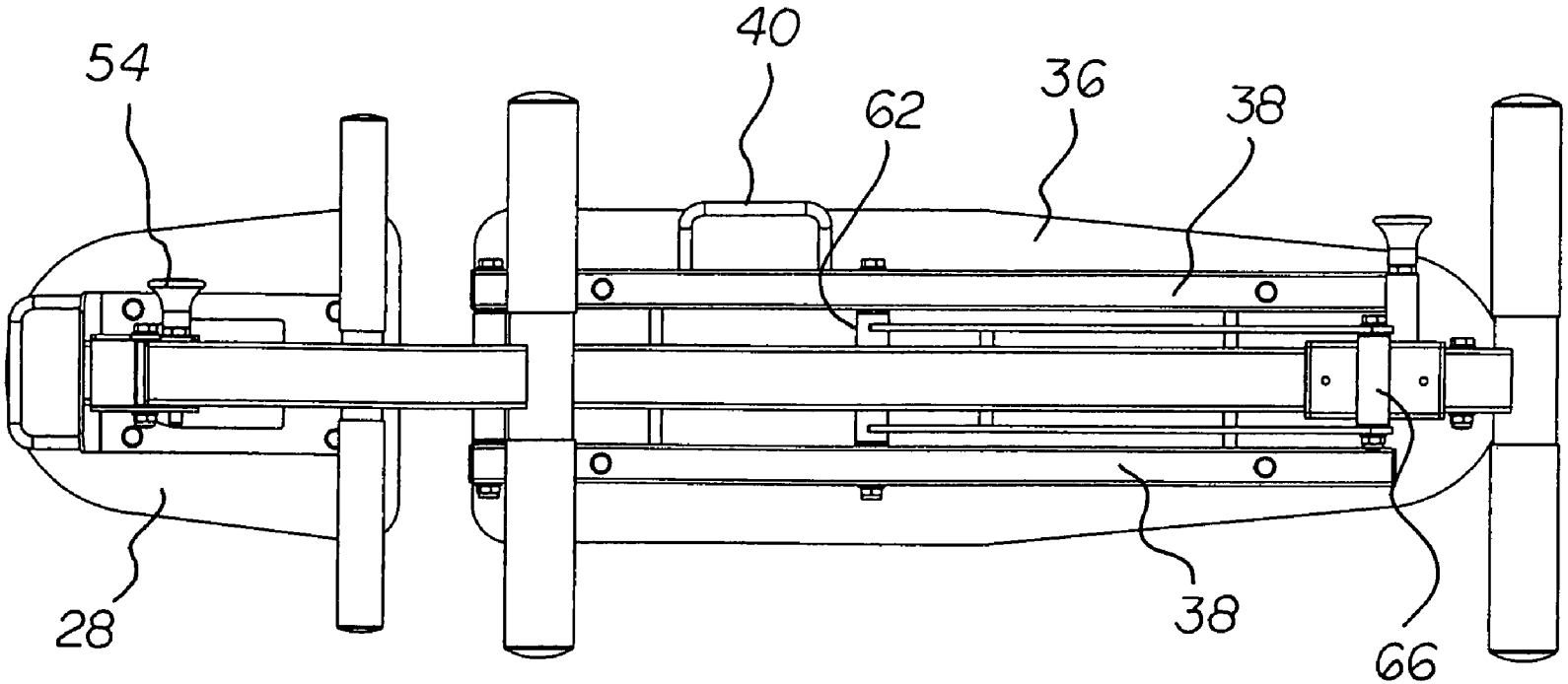
FIG. 10 is a bottom view of the system shown in the prior Figures.

With reference now to the drawings, and in particular to FIG. 1 thereof, the preferred embodiment of the new and improved foldable exercise bench system embodying the principles and concepts of the present invention and generally designated by the reference numeral 10 will be described.

The present invention, the foldable exercise bench system 10 is comprised of a plurality of components. Such components in their broadest context include a base, a seat rest and a rearward adjustment assembly. Such components are individually configured and correlated with respect to each other so as to attain the desired objective.

First provided is a base 14. The base has a primary leg 16. The base has a secondary leg 18. The primary leg is between 3 and 5 times the length of the secondary leg. The primary leg has a rearward end. The rearward end has a rear cross bar 20. The rear cross bar is positionable on the ground. The primary leg has a raised forward end. The secondary leg has a forward end. The forward end has a front cross bar 22. The front cross bar is positionable on the ground. The secondary leg has a rearward end. The rearward end is pivotably coupled to the forward end of the primary leg. The secondary leg has an intermediate cross bar 24. The intermediate cross bar is provided at an intermediate location. The intermediate cross bar functions as a foot rest. Each of the cross bars is provided parallel with the others with a circular cross section. Both of the legs have a rectangular cross section. The legs have an upper surface. The legs have a parallel lower surface. The legs have parallel side surfaces. The side surfaces are provided between the upper and lower surfaces.

A seat rest 28 is provided. The seat rest has a lower surface. The lower surface is secured to the upper surface of the primary leg adjacent to the raised forward end. The seat rest has a cushioned upper surface. The upper surface is adapted to receive and support a seat of a user. The seat rest has a length of between about 15 and 25 percent of the length of the primary leg. A minor extent of the seat rest extends forwardly of the primary leg. In this manner an overhang 30 is constituted. The seat rest has a forward handle 32. The forward handle extends forwardly from the forward end of the primary leg beneath the overhang.

Provided next is a back rest 36. The back rest has a free rearward end. The back rest has a forward end. The forward end is pivotally secured to the upper surface of the primary leg rearwardly of the seat rest. The back rest has a lower surface. The back rest has spaced parallel supports 38. The supports span the primary leg. The back rest has a cushioned upper surface. The upper surface is adapted to receive and support a back of a user. The back rest has a lateral handle 40. The lateral handle extends laterally from one of the parallel supports. The majority of the lateral handle is located beneath the back rest.

Further provided is a forward adjustment assembly 44. The forward adjustment assembly includes a pivot plate 46. The pivot plate extends downwardly from the lower surface of the primary leg adjacent to the forward end. The forward adjustment assembly includes a pivot pin 48. The pivot pin extends through the upper end of the secondary leg and the pivot plate. In this manner the pivoting of the secondary leg between a retracted orientation and an extended orientation is allowed. In the retracted orientation, the secondary leg is positioned adjacent to the primary leg. In this extended orientation, the secondary leg is positioned at an angle of between 80 and 100 degrees from the primary leg. The pivot plate has locking holes 50, 52. The pivot plate has a locking pin 54. The locking pin is positioned through the secondary leg and a preselected locking hole for securement of the secondary leg in a preselected orientation.

Provided last is a rearward adjustment assembly 58. The rearward adjustment assembly includes a pair of parallel adjustment bars 60. The adjustment bars have upper ends. The upper ends have an upper pivot tube 62. The upper pivot tube pivotally couples the upper ends of the adjustment bars to the parallel supports. The rearward adjustment assembly includes a slider 64. The slider has a rectangular cross section. The rectangular cross section is slidable along the primary leg. The adjustment bars have lower ends. The lower ends have a lower pivot tube 66. The lower pivot tube is secured to the slider beneath the primary tube. The lower pivot tube couples the lower ends of the adjustment bars to the lower pivot tubes. In this manner the pivoting of the back rest between a retracted orientation and an extended orientation is allowed. In the retracted orientation, the back rest is positioned adjacent to the primary leg. In the extended orientation, the back rest is positioned at any of a plurality of angles of between 10 and 90 degrees from the primary leg. The slider has adjusting holes 68. The slider has an adjusting pin 70. The adjusting pin is positioned through the slider and a preselected locking hole for securement of the back rest in a preselected orientation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A foldable exercise bench system system repositionable for supporting a user in a plurality of angular orientations while performing exercises, the repositioning being achieved in a safe, convenient and economical manner, the system essentially consisting of, in combination:

a base having a primary leg and a secondary leg, the primary leg being between 3 and 5 times the length of the secondary leg, the primary leg having a rearward end with a rear cross bar positionable on the ground and a raised forward end, the secondary leg having a forward end with a front cross bar positionable on the ground and a rearward end pivotably coupled to the forward end of the primary leg, the secondary leg having an intermediate cross bar at an intermediate location functioning as a foot rest, each of the cross bars being parallel with each other with a circular cross section, both of the legs having a rectangular cross section with an upper surface and a parallel lower surface and with parallel side surfaces between the upper and lower surfaces;

a seat rest having a lower surface secured to the upper surface of the primary leg adjacent to the raised forward end, the seat rest having a cushioned upper surface adapted to receive and support a seat of a user, the seat rest having a length of between about 15 and 25 percent of the length of the primary leg with a minor extent of the seat rest extending forwardly of the primary leg to constitute an overhang, a forward handle extending forwardly from the forward end of the primary leg beneath the overhang;

a back rest having a free rearward end and a forward end pivotally secured to the upper surface of the primary leg rearwardly of the seat rest, the back rest having a lower surface with spaced parallel supports spanning the primary leg and a cushioned upper surface adapted to receive and support a back of a user, a lateral handle extending laterally from one of the parallel supports with the majority of the lateral handle being located beneath the back rest, the forward handle and lateral handle being in a common plane when in a retracted orientation;

a forward adjustment assembly including a pivot plate extending downwardly from the lower surface of the primary leg adjacent to the forward end, a pivot pin extending through the upper end of the secondary leg and through the pivot plate to allow the pivoting of the secondary leg between a retracted orientation adjacent to the primary leg and an extended orientation at an angle of between 80 and 100 degrees from the primary leg, the pivot plate having locking holes with a locking pin positioned through the secondary leg and a preselected locking hole for securement of the secondary leg in a preselected orientation; and a rearward adjustment assembly including a pair of parallel adjustment bars, the adjustment bars having lower ends located beneath the primary leg and spanning the primary leg, the adjustment bars having upper ends with an upper pivot tube pivotally coupling the upper ends of the adjustment bars to the parallel supports, a slider having a rectangular cross section slidable along the primary leg, the adjustment bars having lower ends with a lower pivot tube secured to the slider beneath the primary leg and coupling the lower ends of the adjustment bars to the lower pivot tubes to allow the pivoting of the back rest between a retracted orientation adjacent to the primary leg and an extended orientation at any of a plurality of angles between 10 and 90 degrees from the primary leg, the slider having adjusting holes with an adjusting pin positioned through the slider and a preselected locking hole for securement of the back rest in a preselected orientation.

* * * * *